US009488003B2

(12) United States Patent
Lampe et al.

(10) Patent No.: US 9,488,003 B2
(45) Date of Patent: Nov. 8, 2016

(54) PORTABLE LADDER WITH A STAND OFF DEVICE

(71) Applicant: Lampe Holding B.V., Luchthaven Schiphol (NL)

(72) Inventors: Caspar Bernard Lampe, Luchthaven Schiphol (NL); Maarten Olden, Amsterdam (NL)

(73) Assignee: LAMPE HOLDING B.V., Luchthaven Schiphol (NL)

( * ) Notice: Subject to any disclaimer, the term of this patent is extended or adjusted under 35 U.S.C. 154(b) by 0 days.

(21) Appl. No.: 14/476,144

(22) Filed: Sep. 3, 2014

(65) Prior Publication Data

US 2014/0374192 A1 Dec. 25, 2014

Related U.S. Application Data

(63) Continuation of application No. 13/499,991, filed as application No. PCT/NL2010/050656 on Oct. 6, 2010, now Pat. No. 8,844,675.

(30) Foreign Application Priority Data

Oct. 7, 2009 (NL) ..... 2003605

(51) Int. Cl.

| | |
|---|---|
| ***E06C 7/48*** | (2006.01) |
| ***E06C 7/14*** | (2006.01) |
| ***E06C 7/18*** | (2006.01) |
| ***E06C 1/12*** | (2006.01) |

(52) U.S. Cl.

CPC . *E06C 7/48* (2013.01); *E06C 1/12* (2013.01); *E06C 7/14* (2013.01); *E06C 7/182* (2013.01)

(58) Field of Classification Search

CPC ..... E06C 7/48

See application file for complete search history.

(56) References Cited

U.S. PATENT DOCUMENTS

| | | | |
|---|---|---|---|
| 1,918,293 | A | 7/1933 | Seiler |
| 2,388,892 | A | 11/1945 | Wilson |

(Continued)

FOREIGN PATENT DOCUMENTS

| | | | |
|---|---|---|---|
| GB | 2398339 | A | 8/2004 |
| JP | 2003-120159 | A | 4/2003 |

(Continued)

OTHER PUBLICATIONS

Partial European Search Report for EP13196479 Dated Apr. 9, 2014.

(Continued)

*Primary Examiner* — Alvin Chin-Shue

(74) *Attorney, Agent, or Firm* — Hoffmann & Baron, LLP

(57) ABSTRACT

A portable ladder has two stiles interconnected by rungs. The ladder is provided with a stand off device, including two stand off arm assemblies, each being telescopically inserted into a receiving space. Each stand off arm assembly has a base part and a stand off arm interconnected by a hinge that allows the stand off arm to be pivoted between a position in alignment with the base part and an angled stand off position. The stand off arm assemblies are each configured such that—in extended position—the hinge is located outside the receiving space with the base part being located within said receiving space, and also such that—in retracted position—the base part, the hinge, as well as at least a portion of the stand off arm are located within the receiving space.

8 Claims, 11 Drawing Sheets

(56) References Cited

U.S. PATENT DOCUMENTS

| | | | | | |
|---|---|---|---|---|---|
| 2,478,512 | A * | 8/1949 | Taylor | B62B 7/06 | 16/436 |
| 2,755,981 | A | 7/1956 | Edwards | | |
| 2,923,373 | A | 2/1960 | Ledgerwood | | |
| 3,828,889 | A | 8/1974 | Rehm | | |
| 4,102,433 | A | 7/1978 | Van Valkenburgh | | |
| 4,724,925 | A | 2/1988 | Ritten | | |
| 4,914,783 | A * | 4/1990 | Jackson | B64C 1/14 | 16/363 |
| 5,242,031 | A * | 9/1993 | Ashley | E06C 7/48 | 182/129 |
| 5,931,259 | A | 8/1999 | Hoey | | |
| 6,152,261 | A | 11/2000 | Hoey | | |
| 8,215,453 | B2 | 7/2012 | Mickens | | |
| 2005/0067311 | A1 | 3/2005 | Ferrante | | |
| 2007/0163838 | A1 | 7/2007 | Kim | | |

FOREIGN PATENT DOCUMENTS

| | | | |
|---|---|---|---|
| WO | 02/101189 | A1 | 12/2002 |
| WO | 2008/132418 | A1 | 11/2008 |
| WO | 2009/019162 | A1 | 2/2009 |
| WO | 2009/057995 | A1 | 5/2009 |

OTHER PUBLICATIONS

PCT International Preliminary Report on Patentability Dated Apr. 1, 2012.

PCT International Search Report dated Jan. 19, 2011.

Extended European Search Report for EP13196479 Dated Aug. 26, 2014.

* cited by examiner

PORTABLE LADDER WITH A STAND OFF DEVICE

CROSS-REFERENCE TO RELATED APPLICATIONS

This application a Continuation of U.S. application Ser. No. 13/499,991, filed May 25, 2012, which is the National Stage of International Application No. PCT/NL2010/050656, filed Oct. 6, 2010, which claims the benefit of Netherlands Application No. 2003605, filed Oct. 7, 2009, the contents of all of which are incorporated by reference herein.

FIELD OF THE INVENTION

The present invention relates to a portable ladder with a stand off device arranged in the upper region of the ladder. In general a stand off device serves to space the upper region of the ladder from the object against which the stand off device is placed. For instance, the object is a wall, a pole, a mast, a structural column, a tree, a corner of a building, etc. In general the use of a stand off device provides for increased safety and comfort for a person standing on the ladder, as the person does not have to be as close to the object as when no stand off device was used.

BACKGROUND OF THE INVENTION

It is observed that many designs of stand-off devices are known.

For instance in WO2009/019162 a telescopic ladder is shown with a stand off arm assembly being telescopically inserted in the upper end of each of the tubular stile members of the upper ladder section. Each stand off arm assembly here includes an integral bent component. Slidable latching members, each equipped with a pin, are mounted on the uppermost rung. The stand off arms have a series of holes at different positions, allowing to bring each stand off arm in a variety of positions and secure the selected position by sliding the latching member outwards and inserting the pin through the hole.

SUMMARY OF THE INVENTION

A first aspect of the invention relates to the issue that known stand off devices are unsatisfactory. For instance the size of the known stand off devices is bulky or makes the ladder with the stand off device bulky, e.g. with regard to storage of the ladder. For example with the ladder in WO2009/019162 the user will normally choose to remove the stand off arms when storing the telescopic ladder, as their size and shape makes storage in a small space (e.g. in a service van) impossible.

It is an object of the first aspect of the invention to provide an improved ladder with stand off device, in an advantageous embodiment a telescopic ladder, as well as an improved stand off ladder accessory that can be fastened to a ladder, or at least to provide a useful alternative.

The first aspect of the invention provides a ladder according to the present invention, which is characterised in that each stand off arm assembly has a base part and an stand off arm, said base part and stand off arm being interconnected by a hinge that allows the stand off arm to be pivoted between a position in alignment with the base part and an angled stand off position, wherein the stand off arm assemblies are each configured such that—in extended position of the stand off arm assembly—the hinge is located outside the receiving space associated with the respective stile of the ladder with the base part being located within said receiving space, and wherein the stand off arm assemblies are configured such that—in retracted position of the stand off arm assembly—the base part, the hinge, as well as at least a portion of the stand off arm are located within the receiving space associated with the respective stile of the ladder.

The stand off arm assemblies according to the first aspect of the invention allow for a small or possibly minimal storage space of the ladder.

A stand off arm is preferably embodied as a tubular stand off arm, e.g. an aluminum tube, e.g. of circular cross section.

In a possible embodiment each stand off arm is of telescopic embodiment.

A stand off arm is preferably straight over its entire length, e.g. allowing to retract the stand off arm totally, or at least for a major part, into the receiving space.

In a possible embodiment a stand off arm is provided with a connector portion adapted to connect a further object to the stand off arm, e.g. by means of a releasable fastener. Such an object may e.g. be a bent component as in WO2009/019162. The object may e.g. also be a cross member to be releasably fastened to both stand off arms.

In a highly preferred embodiment the ladder stiles are tubular ladder stiles and each receiving space is formed in the interior of an upper portion of the tubular ladder stile.

In another embodiment the receiving spaces are formed by receiving members that are distinct from the ladder stiles, e.g. to be fastened, releasably or permanently, alongside the ladder stiles.

In another embodiment the ladder stiles each have a recessed exterior portion along their length, e.g. in a U-shaped cross section type ladder stile, said recessed exterior portion forming the receiving space associated with the ladder stile.

In a most preferred embodiment the ladder is a telescopically extendable and collapsible portable ladder having an upper ladder section and multiple further ladder sections, each of said ladder sections having two tubular stiles members arranged parallel to each other and interconnected by a ladder rung; the stile members of each ladder section being telescopically inserted into the stile members of an adjacent ladder section, the ladder further comprising latch mechanisms for locking the telescopically inserted stile members relative to one another when the ladder sections are extended, and wherein the receiving space for each stand-off arm assembly is formed in the stile member of the upper ladder section.

Such a ladder can e.g. be based on the telescopic ladder as is shown in WO2009/057995.

Preferably the ladder includes a locking mechanism adapted to lock each stand off arm in its angled stand off position. This can e.g. be formed by a user operable locking mechanism that attaches the stand off arm in angled stand off position directly to the stile of the ladder.

In a preferred embodiment each stand off arm assembly includes a hinge lock mechanism associated with the respective hinge and adapted to lock the hinge in angled stand off position of the stand off arm. Preferably the hinge lock mechanism is adapted to lock solely in the angled stand off position.

In a preferred embodiment, the hinge is embodied such that—with the stand off arm in extended position and the stand off arm aligned with the base part—the stand off arm is unstable, in particular when the ladder is held vertically, so that the stand off arm will tilt to its angled position automatically. For instance the hinge has a hinge axis that is offset from a vertical line through the center of gravity of the stand off arm and any parts that are connected to said stand off arm, e.g. when the stand off arms are interconnected by a cross member, even when the ladder is held in vertical position. This will cause the stand off arm to tilt in the direction of its angled stand off position.

In a preferred embodiment the hinge lock mechanism automatically locks the hinge when the stand off arm reaches its angled stand off position, and the hinge lock mechanism includes a user operable actuator to effect release of the hinge lock. This prevents the user from forgetting to employ the hinge lock. It will be appreciated that the automatic locking is advantageous in combination with the hinge that renders the stand off arm unstable in extended position.

It is preferred for the user operable actuator of the hinge lock mechanism to be embodied such that it will move into the receiving space when the stand off arm assembly is brought in its retracted position.

In a preferred embodiment the user operable actuator is a slidable actuator, e.g. recessed with the stand off arm.

In a preferred embodiment the ladder includes a stand off arm assembly latch mechanism engaging on the base part of the assembly to latch each stand off arm assembly in its extended position.

With a telescopic ladder it is preferred for the latch mechanism being housed within the rung of the upper ladder section. For instance the latch mechanism can be similar to the latch mechanism known for latching a ladder section with respect to another ladder section, e.g. including a spring loaded latching member at each end of the rung that can extend into the stile member in a manner to lock the stile members relative to one another. Preferably the latch mechanism includes one or two user operable actuators, e.g. sliding buttons, e.g. on a front face of the ladder rung, for operating said latching mechanism. For example two actuators are arranged centrally on a ladder rung (preferably on the front) and are operable simultaneously with a single hand of the user.

In a preferred embodiment—with the stand off arm in angled stand off position—the base part is rotatable within the respective receiving space, thereby allowing to bring the stand off arms in a non-parallel, preferably spreaded, position. When the base part is received in the top end portion of a tubular stile, the axis of this rotation will preferably be parallel to, or coincidental with, the longitudinal axis of the stile.

Preferably the stand off arm assembly latch mechanism is configured to latch each extended stand off arm solely in a non-parallel, preferably spreaded, position of the stand off arms.

In a preferred embodiment the stand off device further includes a cross member having connecting portions, preferably end portions, that are connected to the stand off arms, and a central portion between said connecting portions, preferably the connecting portions being connected to the free ends of the stand off arms. In general the cross member may serve to be placed against an object, such as a wall, pole, mast, column, corner of a building, etc.

In one embodiment, the central portion is monolithic with the connecting portions.

With the connecting portions embodied as end portions, the cross member does not extend beyond the stand off arms, which is preferred. It is however also possible that the cross member is longer than the distance between the stand off arms, e.g. extending outwardly beyond each stand of arm.

In a preferred embodiment at least the central portion of the cross member is configured to lie against, preferably on top of, the uppermost rung of the ladder when the stand off arm assemblies are in retracted position. This enhances the storage of the ladder, as well as its use when the stand off device is not employed.

In a preferred embodiment the cross member has a structure of variable length between its connecting portions. As will be explained below this variable length may serve several purposes and can be achieved by many different layouts.

In a preferred embodiment the cross member has a telescopic structure, at least between the connecting portions. Preferably the central portion is embodied as a central part that is telescopically interconnected with each of the connecting portions.

In a possible embodiment the cross member includes one or more rods, e.g. two parallel rods, fastened to each connecting portion, e.g. hinged, said one or more rods being slidingly retained by the central part, e.g. extending through a corresponding aperture in the central member. The rods may e.g. be of metal, e.g. stainless steel.

In a preferred embodiment the central portion of a cross member is flexible, e.g. so as to deflect when placed against an object exerting a local load on the central member, e.g. a pole, corner of a building, etc. This can e.g. be achieved by making at least a portion of the cross member of a thermoplastic rubber material.

In general it is preferred, even with a rigid central portion, to have a cross member which includes one or more portions of thermoplastic rubber, at least on its exterior, preferably at least the central portion or part thereof having an exterior made at least partly of thermoplastic rubber, possibly also the connecting portions having an exterior made at least partly of thermoplastic rubber.

In an embodiment, the stand off arms may have end caps, which may be part of the connecting portions in case a cross member is provided, with an exterior made at least partly of thermoplastic rubber.

In combination with the feature that the cross member in retracted position of the stand off arms rests on top of the rung, the embodiment with at least exterior portions of the cross member being made of thermoplastic rubber, brings along the advantage of these portions acting as a resilient fender.

In a preferred embodiment the ladder further includes an items storage bag, the stand off device and the storage bag having cooperating fastening means allowing to suspend the items storage bag from the stand off device with the stand off arms thereof in angled stand off position, e.g. the central portion—when present—of the cross member having fastening means cooperating with the items storage bag. For instance with a telescopic ladder one can envisage that the stand off device is deployed and the bag fitted (or already present). The user can then deposit items in the bag, e.g. tools, and then extend the telescopic ladder.

Preferably, the bag is made of a net, allowing to see the content from below.

Preferably also the bag and the uppermost rung of the ladder have cooperating fastening means to suspend the items storage bag from said uppermost rung. Most preferably the items storage bag has a straight upper edge extending closely along the uppermost rung, e.g. the upper edge being reinforced by a profile member. This prevents objects from falling in a gap between the rung and the bag.

In a possible embodiment the items storage bag is embodied to remain connected to the ladder with the stand off arm assemblies in retracted position.

The first aspect of the invention also relates to a telescopically extendable and collapsible portable ladder according to the present invention.

The first aspect of the invention also relates to a stand off device ladder accessory adapted to be fastened to the upper region of a portable ladder having two elongated stiles interconnected by ladder rungs according to the present invention.

In an embodiment, the stand off device ladder accessory comprises a main structure adapted to be fastened to the upper region of a portable ladder, wherein the main structure comprises the receiving spaces for the respective stand off arm assemblies.

The first aspect of the invention also relates to the combination of a ladder accessory according to the present invention and a portable ladder having two elongated stiles interconnected by ladder rungs.

A second aspect of the invention relates to a portable ladder having two elongated stiles interconnected by ladder rungs, wherein the ladder is provided in its upper end region with a stand off device, wherein said stand off device comprises two stand off arms, each stand off arm being movably mounted to a respective stile, at least pivotable about a first axis between a position parallel to the respective stile and an angled stand off position, and wherein the stand off device further includes a cross member connected to the stand off arms. The cross member may have connecting portions, preferably end portions, that are connected to the stand off arms, and a central portion between said connecting portions, preferably the connecting portions being connected to the free ends of the stand off arms.

In a ladder according to the second aspect of the invention the stand off arms could be embodied as telescopic stand off arms with a cross member as in the first aspect of the invention. However other designs with a pivotable connection between the ladder and the stand off arms are also possible. For example each stand off arm could be fastened to a ladder stile, e.g. the top end thereof, via a hinge having an axis parallel to a rung of the ladder. For storage the stand off arms could then be positioned parallel and alongside the ladder stiles so as to occupy relatively little space. By pivoting the stand off arms with the cross member downwards the angled stand off position can be reached.

The second aspect of the invention aims to allow for a relative compact storage of the ladder, yet allow for a stable support of the ladder with the stand off arms deployed in their angled stand off position.

The second aspect of the invention achieves this aim by providing a ladder, wherein the stand off arms are each also pivotable about a second axis, different from the first axis, e.g. parallel or coinciding with the longitudinal axis of a ladder stile, relative to the respective stile allowing to move the stand off arms—when in angled stand off position—between different mutual positions, e.g. between a parallel position and a non-parallel, preferably spreaded, position with respect to each other, Also the cross member has a structure of variable length, e.g. between its connecting portions, allowing said pivoting of each of the stand off arms about said second axis.

The second aspect of the invention provides a portable ladder having two elongated stiles interconnected by ladder rungs, wherein the ladder is provided in its upper end region with a stand off device, wherein said stand off device comprises two stand off arms, each stand off arm being movably mounted to a respective stile, at least pivotable about a first axis between a position parallel to the respective stile and an angled stand off position, and wherein the stand off device further includes a cross member connected to the stand off arms, characterized in that the stand off arms are each also pivotable about a second axis, different from the first axis, relative to the respective stile allowing to move the stand off arms—when in angled stand off position—between different mutual positions, e.g. between a parallel position and a non-parallel, preferably spreaded, position with respect to each other, and characterized in that the cross member has a structure of variable length allowing said pivoting of each of the stand off arms about said second axis.

In a suitable embodiment this allows to position the free ends of the stand off arms further apart than when no rotation about the second axis were possible.

For example the hinge with said first axis has one portion that is rotatably mounted, either releasable or permanent, onto the upper end of a ladder stile, so as to rotate about a second axis parallel or coinciding with the ladder stile.

The second aspect of the invention also relates to a stand off ladder accessory adapted to be fastened to the upper region of a portable ladder having two elongated stiles interconnected by ladder rungs, wherein the ladder accessory comprises a main structure to be fastened to the ladder and two stand off arms, each stand off arm being movably mounted to the main structure, at least pivotable about a first axis between a position parallel to a stile of the ladder and an angled stand off position, and wherein the ladder accessory further includes a cross member connected to the stand off arms, characterized in that the stand off arms are each also pivotable about a second axis, different from the first axis, relative to the main structure allowing to move the stand off arms—when in angled stand off position—between different mutual positions, e.g. between a parallel position and a non-parallel, preferably spreaded, position with respect to each other, and characterized in that the cross member has a structure of variable length allowing said pivoting of each of the stand off arms about said second axis.

The second aspect of the invention also relates to the combination of a ladder accessory as above and a portable ladder having two elongated stiles interconnected by ladder rungs.

It will be appreciated that the ladder and ladder accessory of the second aspect of the invention may have one or more additional features already described with reference to the first aspect of the invention. E.g. the structure of the hinge, the hinge locking device, and/or the structure of the cross member may include one or more of said features.

A third aspect of the present invention relates to a portable ladder having two elongated stiles interconnected by ladder rungs, wherein the ladder is provided in its upper end region with a stand off device, wherein said stand off device comprises two stand off arms, and wherein the stand off device further includes a cross member having connecting portions, preferably end portions, that are connected to the stand off arms, and a central portion between said connecting portions, preferably the connecting portions being connected to the free ends of the stand off arms.

The aim of the third aspect of the invention is to provide an improved cross member, or at least provide a useful alternative for existing cross members.

The third aspect of the invention achieves this aim by providing a portable ladder having two elongated stiles interconnected by ladder rungs, wherein the ladder is provided in its upper end region with a stand off device, wherein said stand off device comprises two stand off arms, and wherein the stand off device further includes a cross member connected to the stand off arms, characterised in that the cross member has a structure of variable length.

As already explained with reference to the cross member with variable length in the ladder according to the first aspect of the invention, the possibility of variation of cross member length may allow for an adaptation of the cross member to the object against which the cross member is resting, e.g. relevant when the cross member is placed against a pole, mast or tree, or against the corner of a building.

Preferred embodiments of the cross member of variable length have already been described with reference to the first aspect of the invention The third aspect of the invention also relates to a stand off device ladder accessory adapted to be fastened to the upper region of a portable ladder having two elongated stiles interconnected by ladder rungs, wherein the ladder accessory comprises two stand off arms, and wherein the ladder accessory further includes a cross member connected to the stand off arms, characterised in that the cross member has a structure of variable length.

The third aspect of the invention also relates to the combination of a ladder accessory as above and a portable ladder having two elongated stiles interconnected by ladder rungs.

The fourth aspect of the invention relates to a portable ladder having two elongated stiles interconnected by ladder rungs, wherein the ladder is provided in its upper end region with a stand off device, wherein said stand off device comprises two stand off arms, each stand off arm being movably mounted to a respective stile between a storage position and a stand off position, and wherein the stand off device further includes a cross member connected to the stand off arms, preferably connected to the free ends of the stand off arms. The cross member may include a central portion as well as connection portions, e.g. end portions, connected to the stand off arms.

A drawback of known ladders with a stand off device is that the cross member—when the ladder is stored or when the stand off device is not deployed—is some sort of an obstacle, e.g. in view of required storage space and/or in view of using the ladder without the stand off device deployed. For this reason the stand off device is often made as an accessory that is releasable from the ladder. However in practice workmen tend not to remove the accessory as this involves extra effort and is time consuming.

The fourth aspect of the invention aims to provide a ladder in which the cross member does not form such an obstacle when the stand off device is not deployed, yet present on the ladder (either as permanent fixture or as removable accessory).

The fourth aspect of the invention achieves this aim by a portable ladder having two elongated stiles interconnected by ladder rungs, wherein the ladder is provided in its upper end region with a stand off device, wherein said stand off device comprises two stand off arms, each stand off arm being movably mounted to a respective stile between a storage position and a stand off position, and wherein the stand off device further includes a cross member, said cross member including a central portion as well as connection portions, e.g. end portions, connected to the stand off arms, characterised in that at least the central portion of the cross member is configured to lie against, preferably on top of, the uppermost rung of the ladder when the stand off arms are in their storage position.

The skilled person will appreciate that aside the telescopic stand off arm assemblies of the first aspect of the invention, many other designs of the stand off arms will allow for such a positioning of the cross member against or preferably on top of the uppermost ladder rung when the stand off device is not deployed. For instance the stand off arms could be directly connected to a respective stile via a hinge at a fixed location at a distance below the top end of the ladder, which distance is such that when the stand off arms are pivoted upward from their angled position into a storage position alongside the ladder stiles, the cross member is in said predetermined position against or on top of the uppermost ladder rung.

It will be appreciated that the cross member may in a preferred embodiment may have one or more of the features described with reference to the first aspect of the invention. For example the cross member may have one or more exterior portions of thermoplastic rubber so as to be a resilient fender for the top of the ladder when the stand off device is not deployed.

The fourth aspect of the invention also relates to a stand off device ladder accessory adapted to be fastened to the upper region of a portable ladder having two elongated stiles interconnected by ladder rungs, wherein the ladder accessory comprises a main structure to be fastened to the ladder and two stand off arms, each stand off arm being movably mounted to the main structure between a storage position and a stand off position, and wherein the ladder accessory further includes a cross member, said cross member including a central portion as well as connection portions, e.g. end portions, connected to the stand off arms, characterised in that—with the accessory fastened to the ladder—at least the central portion of the cross member is configured to lie against, preferably on top of, the uppermost rung of the ladder when the stand off arms are in their storage position.

The fourth aspect of the invention also relates to the combination of a ladder accessory as above and a portable ladder having two elongated stiles interconnected by ladder rungs.

A fifth aspect of the invention relates to a portable ladder having two elongated stiles interconnected by ladder rungs, wherein the ladder is provided in its upper end region with a stand off device, wherein said stand off device comprises two stand off arms, each stand off arm being movably mounted to a respective stile between a storage position and a stand off position, and wherein the stand off device further possibly includes a cross member connected to the stand off arms, preferably connected to the free ends of the stand off arms.

In general the stand off device serves to space the top end of the ladder from the object against which the ladder is resting, e.g. a wall, mostly to facilitate work activities done by a person standing on the ladder.

Often activities require the use of tools or other items, e.g. nails, screws, hammer, screwdriver, etc. It is known to suspend a ladder bag from a rung of the ladder.

The fifth aspect of the present invention aims to provide an improvement over the known ladder bag, or at least a useful alternative.

The fifth aspect of the invention achieves this aim by providing a portable ladder having two elongated stiles interconnected by ladder rungs, wherein the ladder is provided in its upper end region with a stand off device, wherein said stand off device comprises two stand off arms, each stand off arm being movably mounted to a respective stile between a storage position and a stand off position, and wherein the stand off device further possibly includes a cross member connected to the stand off arms, characterised in that the ladder further includes an items storage bag, the stand off device and the storage bag having cooperating fastening means allowing to suspend the items storage bag from the stand off device with the stand off arms thereof in angled stand off position, e.g. the central portion—when present—of the cross member having fastening means cooperating with the items storage bag.

It will be appreciated that the stand off device may have one or more features as discussed with reference to one or more of the other aspects of the invention.

The fifth aspect of the invention also relates to a stand off device ladder accessory adapted to be fastened to the upper region of a portable ladder having two elongated stiles interconnected by ladder rungs, wherein the ladder accessory comprises a main structure to be fastened to the ladder and two stand off arms, each stand off arm being movably mounted to the main structure between a storage position and a stand off position, and wherein the ladder accessory further possibly includes a cross member connected to the stand off arms, characterised in that the ladder accessory further includes an items storage bag, the stand off device and the storage bag having cooperating fastening means allowing to suspend the items storage bag from the stand off device with the stand off arms thereof in angled stand off position, e.g. the central portion—when present—of the cross member having fastening means cooperating with the items storage bag.

The fifth aspect of the invention also relates to the combination a ladder accessory as above and a portable ladder having two elongated stiles interconnected by ladder rungs.

The sixth aspect of the invention relates to a portable ladder having two elongated tubular stiles interconnected by ladder rungs, wherein the ladder is provided in its upper end region with a stand off device, said stand off device comprising two stand off arms, characterized in that each stand off arm is adapted to be stored in a respective tubular stile of the ladder and to be withdrawn fully from the stile for use of the stand off device, and in that the ladder includes in its upper region, preferably at or near the upper end of each stile, a connector part for each stand off arm, the stand off arm and the connector part having cooperation latching means for latching the stand off arm to the connector part, the ladder allowing the user to withdraw each stand off arm from its stored position in the tubular stile and to latch the stand off arm to the connector part, and in that the connector part is adapted to retain the stand off arm in an angled stand off position with respect to the stile of the ladder.

Preferably the connector part is a fixed bracket. Preferably the connector part includes an insertion aperture for receiving an end of the stand off arm that is inserted by the user into said insertion aperture.

In a possible embodiment the connector part is mobile with respect to the stile of the ladder, e.g. rotatable about an axis parallel or coinciding with the longitudinal axis of the stile of the ladder, e.g. allowing to vary the mutual angle between the stand off arms, e.g. between a parallel and a non-parallel position, e.g. a spreaded position.

In a possible embodiment the stand off device further includes a cross member between the stand off arms.

In a possible embodiment the connector part includes a hinge allowing to pivot the stand off arm. Possibly the connector part includes a hinged portion, the hinged portion including a guide means for the stand off arm, e.g. a bore through which the stand off arm extends, the hinged portion being pivotable between a storage position in which the guide means is aligned with the tubular stile and an angled stand off position, wherein in the storage position of the hinged portion each stand off arm cooperates with the guide means, e.g. extends through the bore, of the hinged portion and extends into the stile of the ladder, and wherein—with the hinged portion in its storage position—the stand off arm can be fully drawn from the stile, such that an end portion of the stand off arm remains held by the guide means, e.g. the bore, of the hinged portion, the hinged portion being pivotable to its angled stand off position, preferably a locking mechanism being provided to lock the hinged portion in said angled stand off position.

The seventh aspect of the invention relates to a portable ladder having two elongated tubular stiles interconnected by ladder rungs, wherein the ladder is provided in its upper end region with a stand off device, said stand off device comprising two stand off arms, characterized in that each stand off arm comprises an end cap, and wherein each stand off arm is adapted to be stored in a respective tubular stile of the ladder such that the end cap rests on the upper end of the stile.

Preferably the stand off device includes a cross member extending between the end caps of the stand off arms, and wherein in the stored position the cross member preferably lies against, most preferably on top of, an uppermost rung of the ladder.

It will be appreciated that the invention also relates to a ladder or ladder accessory incorporating any combination of the aspects of the invention.

The present invention also relates to a method for manufacturing a ladder or ladder accessory according to one or more of the aspects of the invention.

The present invention also relates to a method for climbing, wherein use is made of a ladder or ladder accessory according to one or more of the aspects of the invention.

BRIEF DESCRIPTION OF THE DRAWINGS

The aspects of the invention will now be explained with reference to a preferred embodiment of a ladder according to the invention shown in the drawings. In the drawings.

DETAILED DESCRIPTION OF THE INVENTION

Figure 1A:
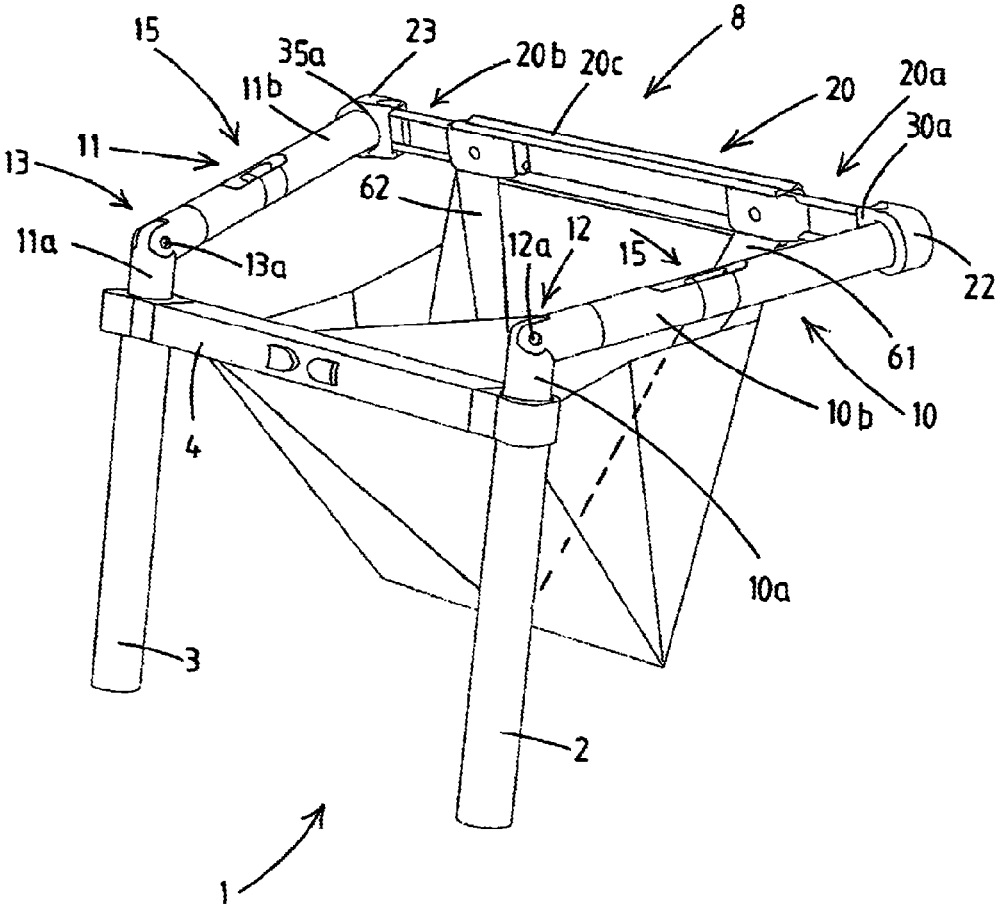
FIG. 1A shows schematically in perspective view the upper ladder section of a telescopic ladder provided with a stand off device and items storage bag according to the invention.

The FIGS. 1A-7 only show the upper ladder section 1 of a telescopically extendable and collapsible portable ladder. This ladder further has multiple further ladder sections. Each of the ladder sections has two tubular stiles members 2,3 arranged parallel to each other and interconnected by a ladder rung 4. The stile members of each ladder section are telescopically inserted into the stile members of an adjacent ladder section. The ladder further comprises latch mechanisms for locking the telescopically inserted stile members relative to one another when the ladder sections are extended. As explained telescopic ladders of such design are known for example from WO2009/057995 or WO02/101189.

It will be appreciated that none of the aspects of the invention are limited to such telescopic ladders. Other telescopic designs, or even rigid, non-telescopic ladders may also benefit from one or more aspects of the invention. However, the integration of one or more of the aspects of the invention into such telescopic ladder is considered very advantageous, e.g. as these ladders are expected to be compact for storage.

The upper ladder section 1 is equipped with a stand off device 8, which—in deployed condition—allows to space the top end of the ladder from an object against which the ladder is resting.

The stand off device 8 comprises two stand off arm assemblies 10, 11 as well as a cross member 20. It is noted that a cross member 20 need not be present in the stand off device, however its presence is preferred. As is most preferred the cross member 20 is an integral, non-removable part of the stand off device, however the cross member 20 could also be a separate part to be fitted on the stand off arms on demand by the user.

Each stand off arm assembly 10, 11 is telescopically received in a hollow space in the upper end of a respective tubular stile member 2, 3 of the upper ladder section 1, so as to be telescopically movable relative to the stile member.

In this example, as is preferred, an assembly 10, 11 can be fully received in the respective stile of the telescopic ladder, here with the exception of the free end portion of the assembly which carries the connecting portion of the cross member 20.

Each stand off arm assembly 10, 11 has a base part 10*a*, 11*a* and a stand off arm 10*b*, 11*b*. The base part 10*a*, 11*a* and the stand off arms 10*b*, 11*b* are interconnected by a hinge 12, 13 that allows the stand off arm 10*b*, 11*b* to be pivoted about a pivot axis 12*a*, 13*a* between a position in alignment with the base part 10*a*, 11*a* (see FIG. 1C) and an angled stand off position (see FIGS. 1A, 2-7).

Figure 1B:
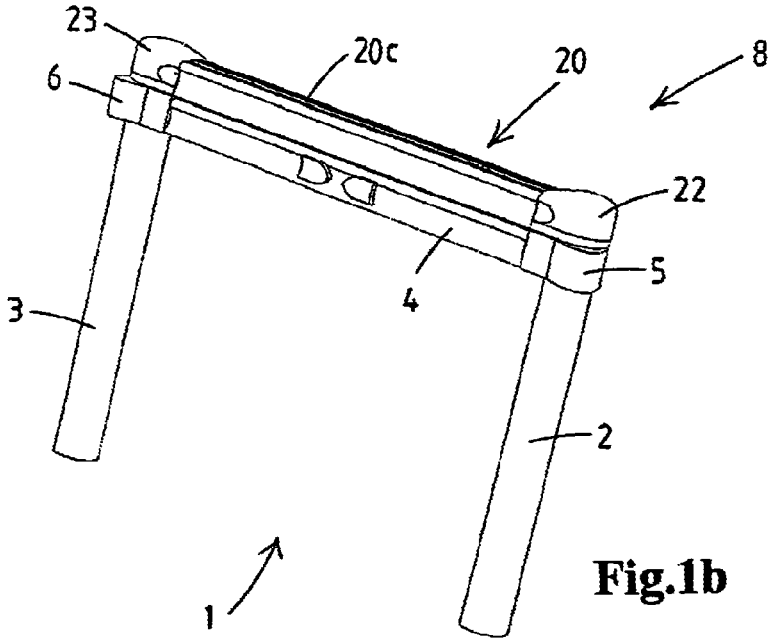
FIG. 1B the upper ladder section according to FIG. 1A in retracted position of the stand off arm assembly.
Figure 1C:
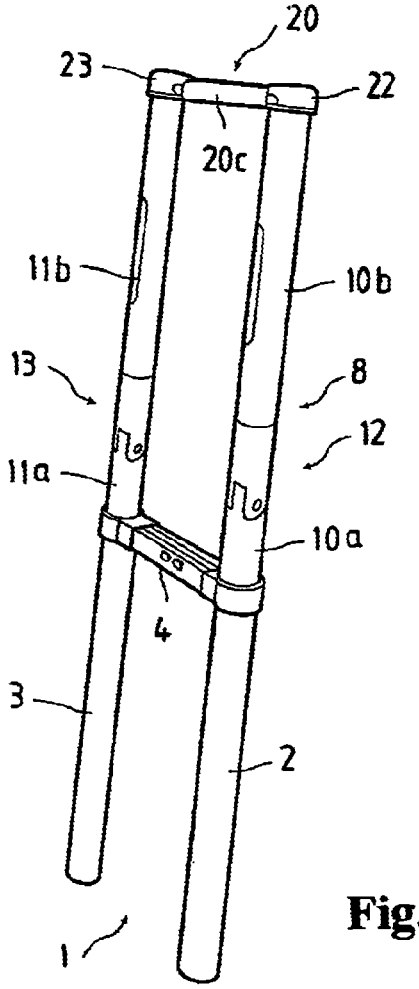
FIG. 1C the upper ladder section according to FIG. 1A in extended position of the stand off arm assembly.
Figure 2:
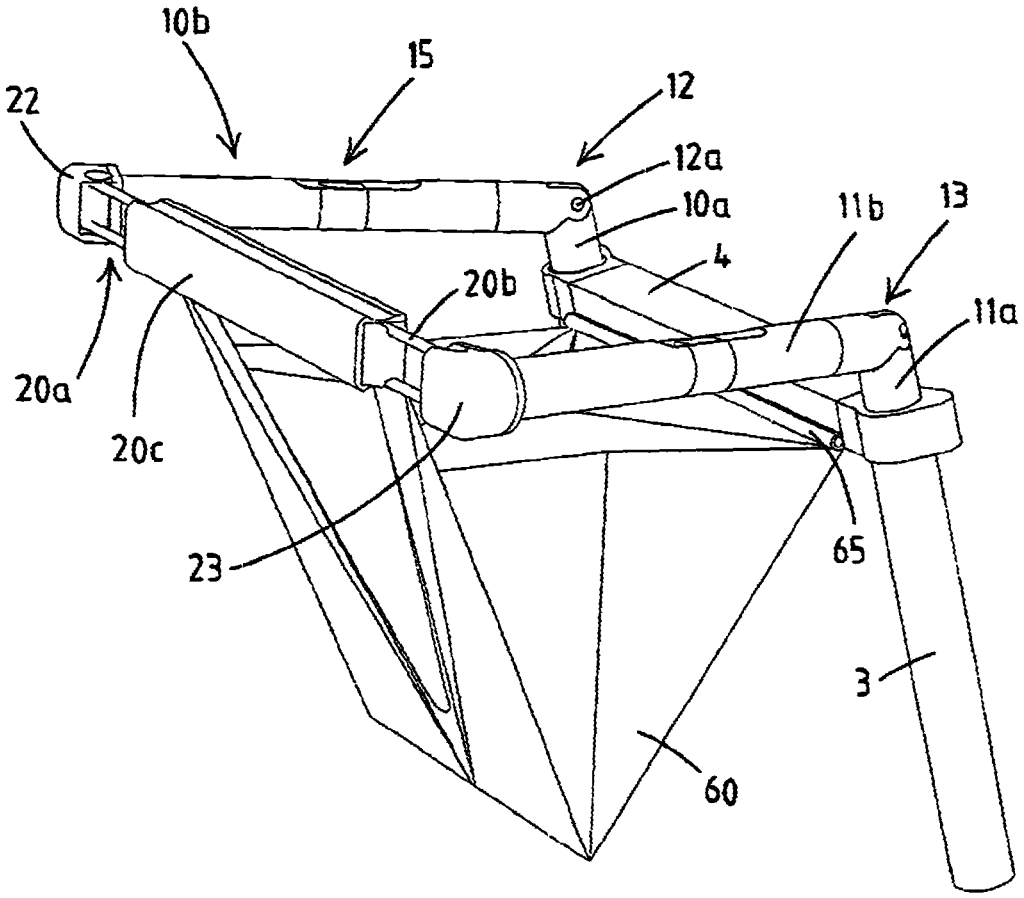
FIG. 2 the upper ladder section of FIG. 1A from another angle.
Figure 3:
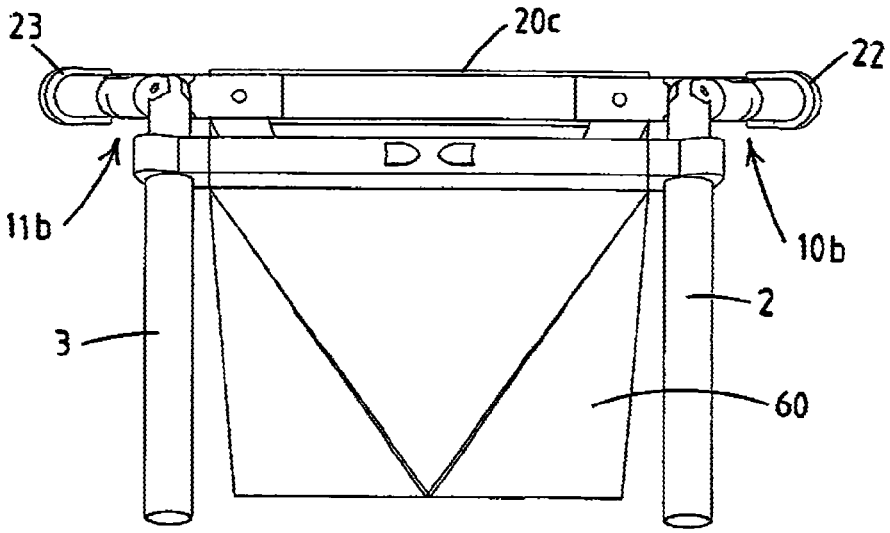
FIG. 3 a front view of the upper ladder section of FIG. 1A.
Figure 4:
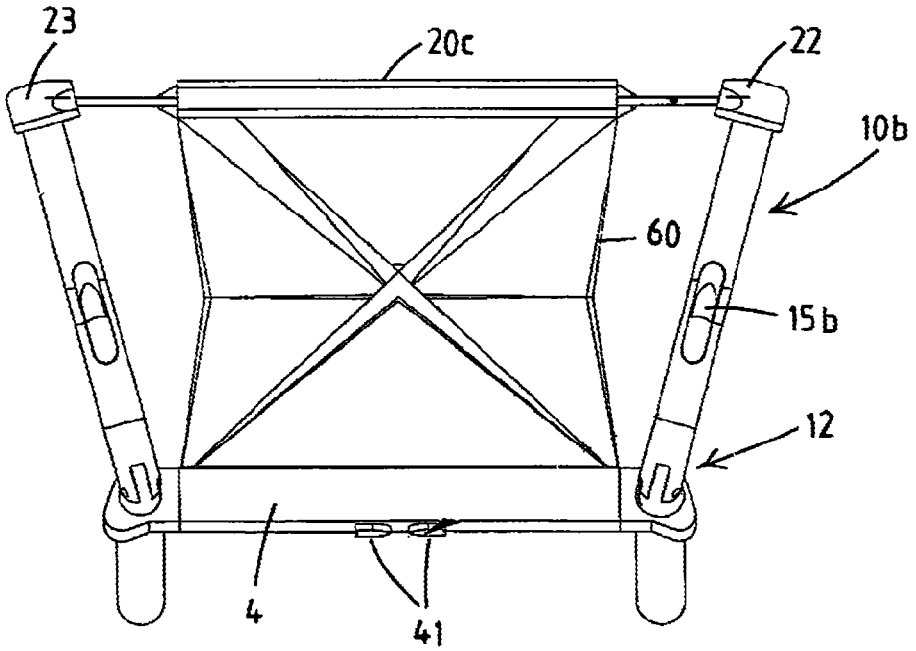
FIG. 4 a view from above of the upper ladder section of FIG. 1A.

The stand off arm assemblies 10, 11 are each configured such that—in extended position of the stand off arm assembly, so when the assembly has been drawn out of the stile member over a suitable length—the hinge 12, 13 is located outside the stile member 2, 3 of the upper ladder section 1 with at least a portion of the base part 10*a*, 11*a* being located within said stile member 2,3, see FIG. 1C.

Also the stand off arm assemblies 10, 11 are configured such that—in retracted position of the stand off arm assembly, so when the assemblies have been pushed or lowered into the stile—the base part 10*a*,11*a*, the hinge 12, 13, as well as at least a portion of the stand off arm 10*b*,11*b* are located within the stile member, see FIG. 1B. As is preferred, in this example, the majority of the stand off arms 10*b*, 11*b* is received within the stile members 2,3; only the free end portion, e.g.; a few centimeters, protrudes out of the stile member 2,3. An abutment surface 30*a*, 35*a* at the free end portion of each stand off arm, here formed by an end cap 22, 23 of the stand off arm, abuts against the upper end of the stile member 2,3 in this example, and so defines the fully retracted position.

As is preferred the stand off arm assemblies 10, 11 fit into the respective stile member 2,3 with a play that allows for easy sliding motion.

In this example, as is preferred, the hinge 12 is made of plastic material, e.g. reinforced plastic material.

In this example, as is preferred, the stand off arms 10*b*, 11*b* are tubular arms, e.g. of aluminum. As is preferred the hinges 12, 13 each have a fastening portion extending into the respective stand off arm 10*b*, 11*b*.

In this example, as is preferred, the hinges 12, 13 have a portion that is monolithic with the base part 10*a*, 11*a*, here made of plastic material, e.g. reinforced plastic material.

A lock mechanism for locking the stand off arms 10*b*, 11*b* in stand off position is provided.

As is preferred a hinge lock mechanism is associated with each of the hinges 12, 13 and adapted to lock the hinge 12, 13 in angled stand off position of the stand off arm (see drawings), so as to hold the stand off arms securely in said position.

In another embodiment, not shown here, a lock mechanism not associated with the hinge could be provided, for example a diagonal strut member can be envisaged between a stand off arm and a portion of the ladder, e.g. a ladder stile.

As is preferred the hinge lock mechanism 15 is embodied to provide its locking action solely in the stand off position of the stand off arms 10*b*, 11*b*. This e.g. allows to avoid that the user will use the cross member 20 as an extra rung, which might seem allowable if the hinges 12, 13 would also lock when the stand off arms 10*b*, 11*b* were aligned with the base parts 10*a*, 11*a*.

As is preferred the hinges 12, 13 are embodied such that—with the stand off arms 10*b*, 11*b* in extended position and the stand off arm aligned with the base part 10*a*, 11*a*—the stand off arm is unstable 10*b*, 11*b*, in particular when the ladder is held vertically, so that the stand-off arm will tilt to its angled position automatically.

Figure 5:
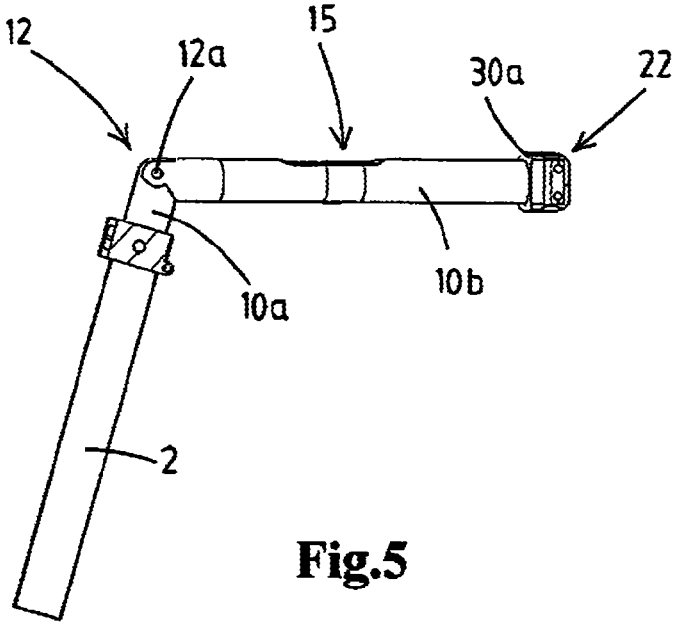
FIG. 5 a line drawing of the stile member of the upper ladder section of FIG. 1A and the associated stand off arm assembly, FIG. 6 the view of FIG. 5 partly in cross section, FIG. 7 the stand off device of the ladder of FIG. 1A from above partly in cross section, FIG. 8 schematically an alternative variable length cross member in view from below, FIG. 9 an example of a stand off ladder accessory according to the invention, FIG. 10 an example of another embodiment of a ladder according to the invention, FIG. 11 an example of yet another embodiment of a ladder according to the invention, FIGS. 12*a-c* a detail of yet another embodiment of a ladder according to the invention.
Figure 6:
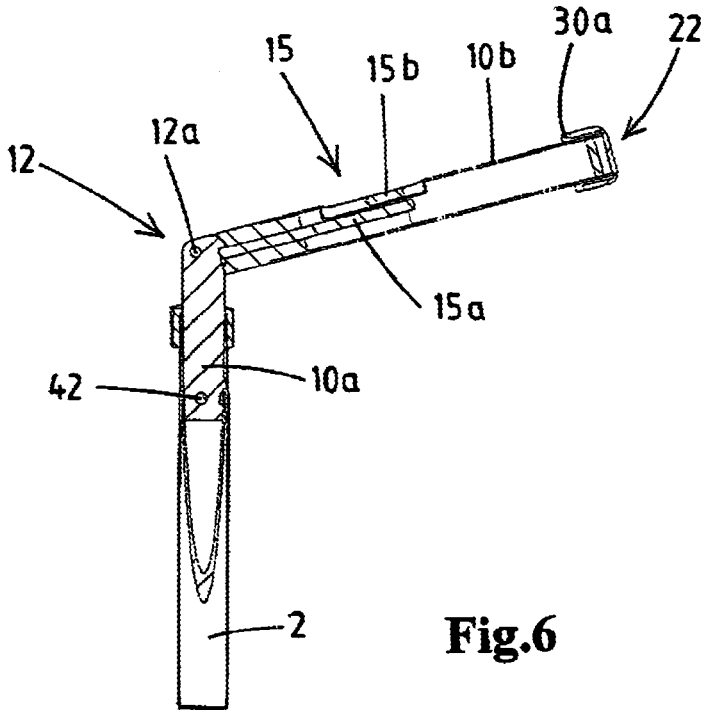
Figure 7:
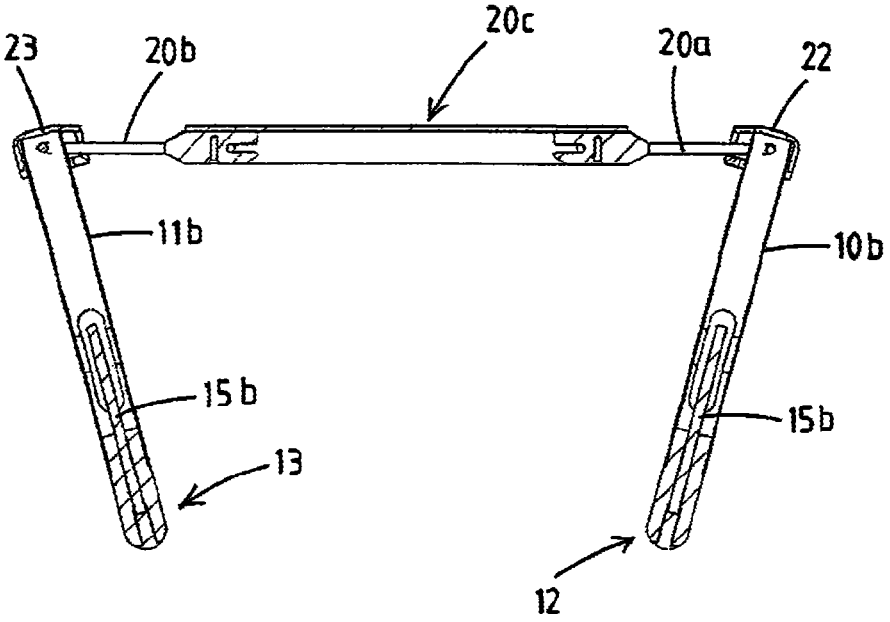

In particular in FIGS. 5 and 6 it can be seen that the hinge axis 12*a* is located offset towards the front side of the ladder with respect to the central longitudinal axis of the assembly 10 when in aligned state of the base part and the stand off arm. The center of gravity of the pivotable part of the stand off device now lies behind the hinge axis 12*a*, at least when the ladder is held vertically, so that said pivotable part will automatically drop to the stand off position.

As in this example the hinge lock mechanism 15 automatically locks the hinge when the stand off arm reaches its angled stand off position, the user does not have to take any action to achieve a secured stand off position of the stand off arms.

In FIG. 6 a mobile locking member, here a pin 15*a* is shown, that is movably retained within the stand off arm 10, e.g. spring loaded towards the locked position. In this example the mobile locking member 15*a* extends through an opening in the portion of the hinge 12 fitted in the tubular stand off arm.

The hinge lock mechanism 15 includes a user operable actuator 15*b* to effect release of the hinge lock. Here, a sliding actuator 15*b* is provided on the stand off arm, and connected to the mobile locking member 15*a*. As is preferred the sliding actuator 15*b* is movable in longitudinal direction of the stand off arm.

As is preferred the actuator 15*b* is recessed within the contour of the stand off arm 10*b*, 11*b*, allowing the actuator 15*b* to be received within the stile member 2,3 in retracted position of the assemblies 10, 11.

In this example, as is preferred, the rung 4 is a hollow metal profile, e.g. aluminum profile.

In this example, as is preferred, the rung 4 is connected at its ends to each of the stile members 2, 3 via a plastic connector element 5,6. An example of such a plastic connector element is e.g. shown in WO2009/057995 or in WO02/101189.

The plastic connector element 5,6 here includes a collar receiving the top end of the stile member 2,3, e.g. with two collar portions to be clamped onto the stile member 2,3 with a tensioning bolt or screw.

In this example, as is preferred, the upper ladder section 1 includes a stand off arm assembly latch mechanism engaging on the base part 10*a*, 11*a* of each assembly 10, 11 to latch each stand off arm assembly in its extended position.

In this example the mechanism is housed within the uppermost rung 4 of the ladder, as is preferred.

The latch mechanism includes a mobile latch member (not shown) at the end of each rung, the latch member being engagable with the assembly 10, 11, in particular the base part 10*a*, 11*a* thereof. For instance, a mobile latch pin is provided that is extendable into a corresponding latch pin opening 42 in the base part 10*a*,11*a*. For example, the latch member is spring loaded into the latching position. For example the latch mechanism may be similar to a latch mechanism for latching the ladder sections in a telescopic ladder, e.g. as in WO2009/057995 or in WO 02/101189.

In this example, as is preferred, each latch member is connected to a user operable actuator 41, here a sliding button. As is preferred both actuators 41 are mounted centrally on the front side of the rung 4. However another position of each actuator, e.g. close to the stile member, is also possible.

As is shown here the base part 10*a*, 11*a* of each assembly 10, 11 is rotatable within the respective stile member 2,3. This allows to bring the stand off arms 10*b*, 11*b* in a non-parallel, spreaded, position when in their stand off position. This can be done by simply pushing each stand off arm 10*b*,11*b* outwards.

So in this example the stand off arms 10*b*,11*b* are each also pivotable about a second axis, here the central longitudinal axis of the stile member 2,3, which second axis different from the first axis 12*a*, 13*a*, relative to the respective stile member 2,3. This allows to move the stand off arms 10*b*,11*b*—when in angled stand off position—between different mutual positions, e.g. between a parallel position and a non-parallel, preferably spreaded, position with respect to each other. As will be explained below the cross member 20 has a structure of variable length to allow for this motion of the stand off arms.

As is preferred the stand off arm assembly latch mechanism is configured to latch each stand off arm 10*b*,11*b* solely in this non-parallel, spreaded, position of the stand off arms. This is here achieved by arranging the opening 42 in this non-parallel orientation.

It will be appreciated that in a simpler version the cross member 20 is of fixed length, e.g. integral with the end caps 22, 23. With the free ends of the stand off arms 10*b*, 11*b* fixed to the ends of the cross member 20 no spreading of the arms will be possible.

In another embodiment the cross member 20 is of a length greater than the distance between the stand off arms 10*b*,11*b* in mutual parallel position, e.g. extending sideways beyond each arm 10*b*, 11*b*.

In another embodiment the cross member is adapted to fasten thereon additional stand off elements e.g. for hanging the ladder from a gutter, or a frame with wheels.

An advantage of locking solely in the spreaded position is that the user will select said spreaded position to secure the stand off arms. In addition, an advantage arises in combination with a variable length cross member 20, as in a suitable embodiment, the cross member will deflect inward (towards the ladder), e.g. when placed against a pole, wherein the stand off arms 10*b*,11*b* may assume a position wherein they are angled towards one another.

The cross member 20 has connecting portions 20*a,b*, here end portions, that are connected to the stand off arms, here the free ends of the stand off arms as is preferred.

A central portion 20*c* extends between the end portions 20*a,b* and is connected thereto.

In this example the cross member 20 is of a telescopic structure, here with the central part 20*c* being telescopically movable relative to each of the end portions 20*a,b*.

In this example each end portion 20*a,b* includes one or more, here two, rods, that are at one end pivotally fastened to the stand off arm 10*b*, 11*b*, said one or more rods being slidingly retained by the central portion 20*c*, e.g. extending through a corresponding aperture in the central portion 20*c*.

The drawings show the cross member 20 in extended state. In fully retracted state, as is preferred, the central portion 20*c* lies between the end cap 22, 23 fitted on the ends of the stand off arms, preferably the end caps and the central portion forming one continuous element of the ladder, most preferably the central portion 20*c* being in contact with said end caps 22, 23.

At least the central portion 20*c* of the cross member 20 is configured to lie against, here on top of, the uppermost rung 4 of the ladder when the stand off arm assemblies 10, 11 are in retracted position.

As is preferred the central portion 20*c* is flexible, e.g. so as to deflect, here bend, when placed against an object exerting a local load on the central member, e.g. a pole, corner of a building, etc.

In this example the main body of the central portion 20*c*, here a longitudinal profile, here of U-shape, is made of a flexible material, preferably of thermoplastic rubber. In this example, end pieces are fitted to said main body, the one or more rods 20*a,b* extending through openings in said end pieces.

Preferably also the end caps 22, 23 are made of thermoplastic rubber.

By making at least portions of the exterior of the central portion 20*c*, and as preferred also of the end caps 22, 23 of thermoplastic rubber, the effect is reached that in retracted position of the assemblies 10,11 these rubber portions act as fenders for the top end of the ladder. Also the rubber provides for extra grip when the stand off device is employed.

It will be appreciated that the cross member also could have another design to achieve a structure of variable length. For instance the rods may be replaced by resilient connecting members, interconnecting the central portion with the stand off arms, e.g. elastic members.

For instance the rods may be replaced by one or more wire, rope or cable or chain members allowing deflection or bending thereof, at least in a direction at right angles to the plane of the central portion so as to facilitate the inward deflection of said central portion.

Figure 8:
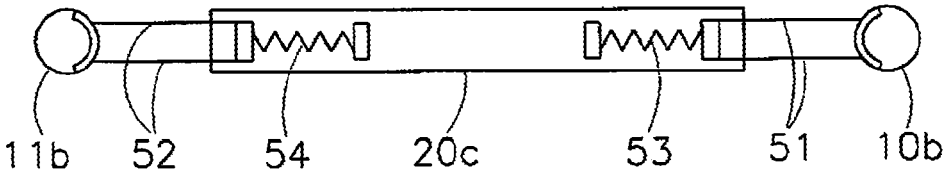

For instance a tensioning arrangement is associated with the central portion, for tensioning the one or more members of the end portions, e.g. one or more tensioning springs. FIG. 8 shows an alternative wherein each end portion includes one or more steel wires 51, 52 connected to a stand off arm 10*b*,11*b*, and having the other end connected to a tensioning arrangement with one or more springs 53,54.

The upper ladder section 1 further includes an items storage bag 60. The stand off device 8 and the storage bag 60 having cooperating fastening means allowing to suspend the items storage bag 60 from the stand off device with the stand off arms thereof in angled stand off position.

In this example, as is preferred, the central portion 20*c* of the cross member 20 has fastening means 61, 62 cooperating with the items storage bag 60. Also the bag 60 and the uppermost rung 4 of the ladder have cooperating fastening means 65 to suspend the items storage bag from the uppermost rung.

In this example the items storage bag 60 has a straight upper edge extending closely along the uppermost rung 4. This is done, as is preferred by the upper edge being reinforced by a profile member 65 and the rung 4 having a longitudinal slot or formation into which the profile member 65 is placed, e.g. clamped.

The items storage bag 60 here is embodied such that it can remain connected to the ladder when the stand off arm assemblies 10, 11 are moved into their retracted position.

As is preferred the bag 60 is made at least partly transparent or of a net material allowing a user to see from below whether something is stored in the bag.

The skilled person will appreciate that the upper ladder section depicted here may also be integrated with a ladder having non-telescopic tubular stiles, the stile members 2,3 then e.g. forming a portion of said stiles or being received in the upper end thereof. Also the stile members 2,3 could be e.g. fitted to the side of the ladder stiles of the non-telescopic ladders.

The skilled person will also appreciate that the upper rung 4 between the stile members could be absent when desired.

Preferably, the stile members 2,3 are received in the ladder stiles of a telescopic ladder such that they are normally non-removable from the ladder, and thus the upper ladder section 1 forms a permanent part of the ladder. Obviously this also could apply to other ladder designs.

However the upper ladder section 1 could also be embodied as stand off ladder accessory, that is easily removable from the ladder, e.g. for storage when not in use. This can e.g. be done as shown in WO2009/019162.

Figure 9:
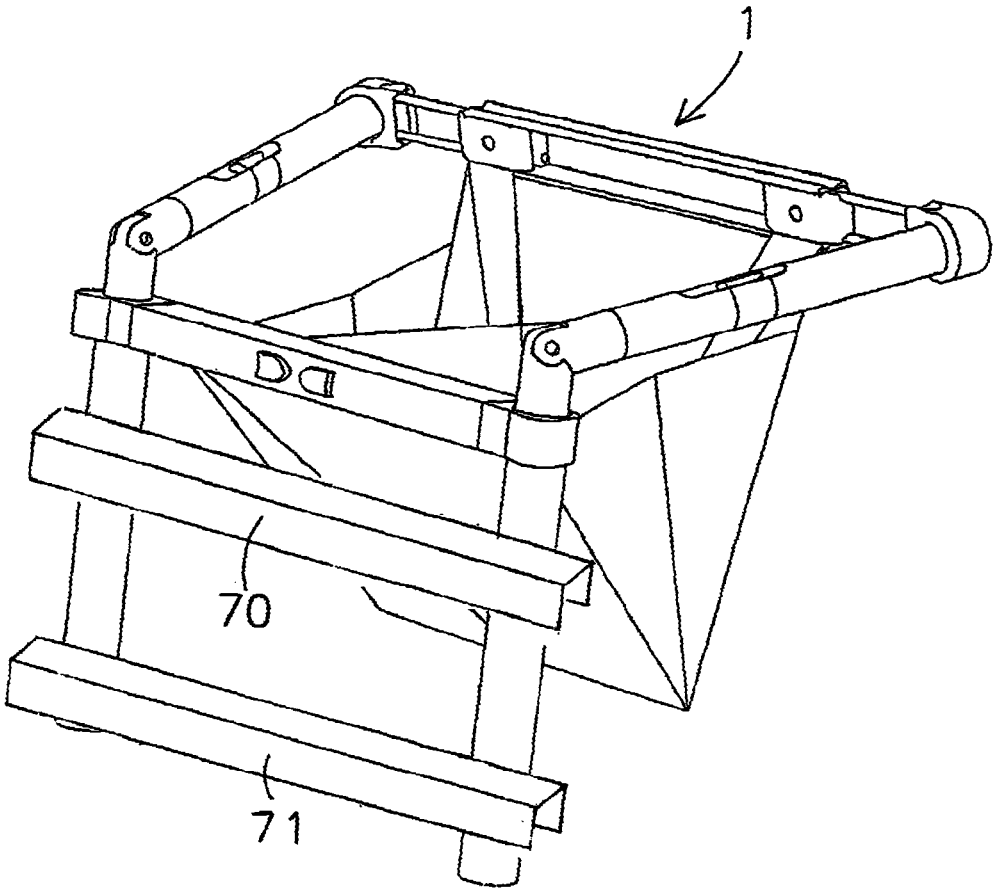

In FIG. 9 an example is shown where the upper ladder section 1 is embodied as a stand off ladder accessory 1' to be fastened removably onto a ladder. In this example the tubular members 2,3 and rung 4 are formed into a main structure of the accessory, here together with brackets 70,71 that can be fitted onto two rungs of a ladder. It will be appreciated that many other designs of such a main structure are possible for a ladder accessory.

Figure 10:
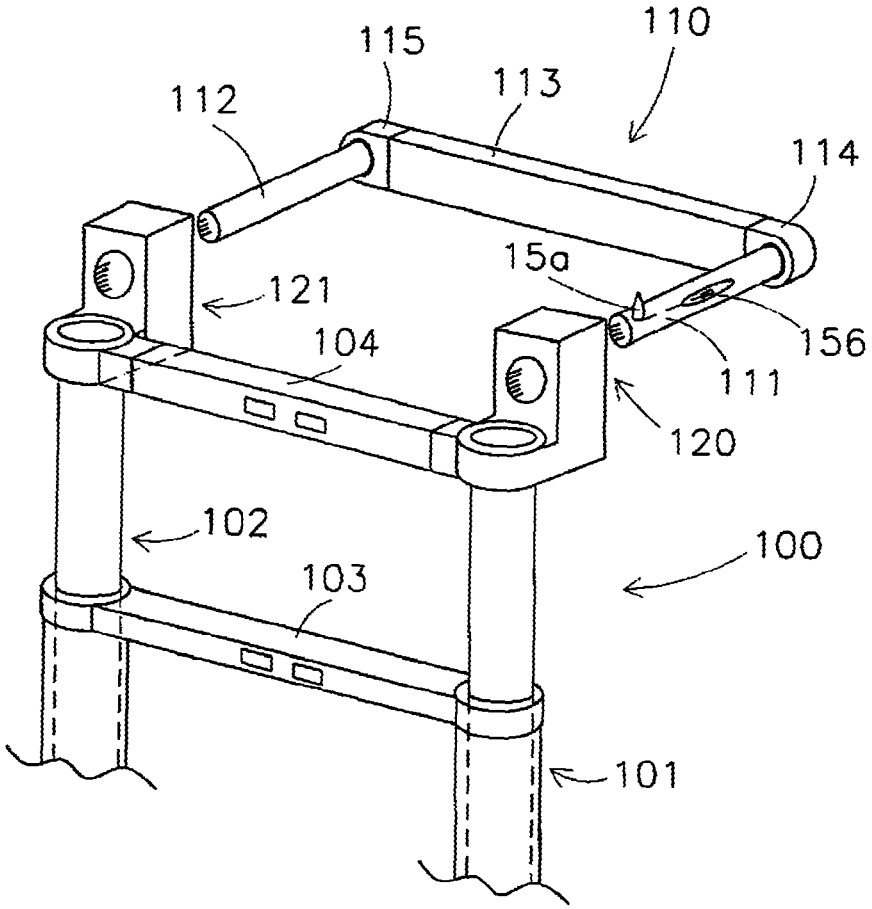

In FIG. 10, a portion of a ladder 100 according to the invention is shown. The ladder includes two elongated tubular stiles 101, 102 interconnected by ladder rungs 103, 104. The skilled person will appreciate that the depicted ladder could be a telescopic ladder with an upper ladder section including stile members and uppermost ladder rung 104, as well as at least one further ladder section including stile members and ladder rung 103. Of course, the ladder stiles 101,102 can also be of non-telescopic design.

In FIG. 10 reference numeral 110 indicates a stand off device, here including two stand off arms 111, 112 as well as a cross member 113. In this example the cross member 113 is monolithic with end caps 114, 115 on the ends of the stand off arms 111, 112.

For example the end caps 114, 115 and cross member 113 are formed as a monolithic part of thermoplastic rubber material. Other designs, e.g. as disclosed with reference to FIGS. 1A-7 of the cross member are also possible.

In ladder 100 each stand off arm 111, 112 is adapted to be stored in a respective tubular stile 101, 102 of the ladder 100. It will be appreciate that in the design shown here each of the end caps 114, 115 act as an abutment on the top end of the ladder, and the remainder of the stand off arms is stored within the stiles. Also in this design, the cross member 113 lies on top of the uppermost rung 104 when the stand off device is stored.

It is envisaged that for use of the stand off device, the user grips the cross member and/or end caps, and pulls on the stand off device so that each stand off arm 111, 112 is fully withdrawn and released completely from the stile. This is in contrast to the embodiments of FIGS. 1A-8, wherein the stand off arm assemblies remain connected to the stile members or receiving members in their extended position.

The ladder 100 furthermore includes in its upper region, here as is preferred near the upper end of each stile 101, 102, a connector part 120, 121 for each stand off arm 111, 112. The connector parts 120, 121 are each adapted to retain a stand off arm 111, 112 in an angled stand off position with respect to the stile of the ladder 101, 102.

The stand off arms 111, 112 and the connector parts 120, 121 have cooperation latching means for latching the stand off arm to the connector part. This could e.g. be formed by a latching mechanism similar to the hinge locking mechanism 15, with a mobile locking part 15*a* that engages on the connector part and that is releasable by user operation of a suitable actuator 15*b* on the stand off arm, e.g. a sliding button.

The ladder 100 allows the user to withdraw each stand off arm 111, 112 from its stored position within the tubular stile 101, 102, here together with the cross member 113, and to latch the stand off arms to the connector parts In this example the connector parts 120, 121 are embodied as fixed brackets, so non-mobile with respect to the stile 101, 102. Each bracket 120, 121 in this example provides for a single mounting position of the stand off arm 111, 112 corresponding to the stand off position of the stand off arm.

In this example each connector part 120, 121 includes an insertion aperture for receiving an end of the stand off arm 111, 112 that is inserted by the user into said insertion aperture.

In an alternative embodiment the connector parts 120, 121 are mobile with respect to the stile of the ladder, e.g. rotatable about an axis parallel or coinciding with the longitudinal axis of the stile of the ladder, e.g. allowing to vary the mutual angle between the stand off arms, e.g. between a parallel and a non-parallel position, e.g. a spreaded position. It will be appreciated that such an embodiment may be advantageous when also use is made of a variable length cross member.

For example when multiple angled stand off positions are desired it can be envisaged that the connector parts 120, 121 each include a hinge allowing to pivot the stand off arm between different stand off angles with respect to the stile.

Preferably a locking mechanism is then provided to lock the stand off arms in the selected angled stand off position.

Figure 11:
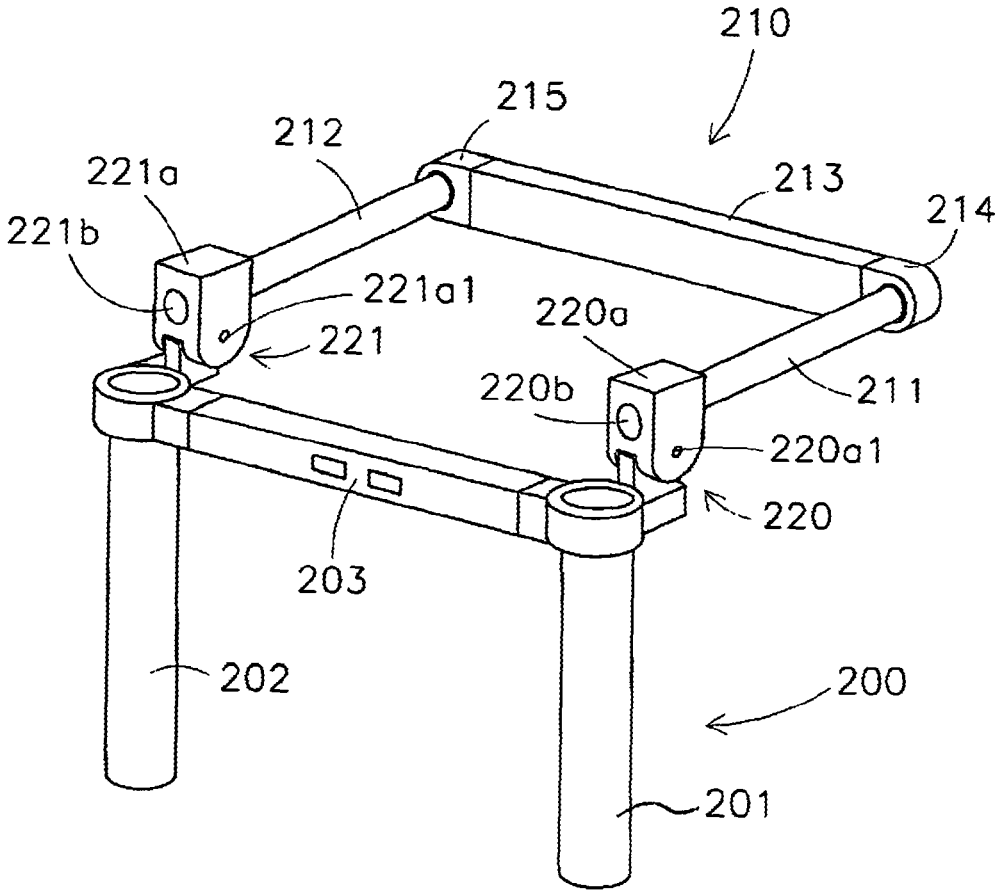

In FIG. 11 an upper part of a ladder 200 is schematically shown. The ladder 200 includes two tubular stiles 201, 202 and rungs, here uppermost rung 203 is visible. As will be appreciated the ladder may be a telescopic ladder or a ladder with non-telescopic tubular stiles.

The ladder 200 includes a stand off device 210 with at least two stand off arms 211, 212 and here also, as is preferred, with a cross member 213. In this example the cross member 213 lies between end caps 214, 215 of the stand off arms, e.g. is integral therewith.

At the upper end of each stile 201, 202 a connector part 220, 221 for each stand off arm 211, 212 is provided. In contrast to the FIG. 10, where each connector part is a fixed bracket, here the connector part includes a hinged portion 220*a*, 221*a* with hinge axis 220*a*1, 221*a*1.

The hinged portions 220*a*, 221*a* each include a guide means for the stand off arm, here a bore 220*b*, 221*b* through which the stand off arm 211, 212 extends.

Each hinged portion 220*a*, 221*a* is pivotable between a storage position in which the bore 220*b*, 221*b* is aligned with the tubular stile 201, 202 and an angled stand off position. Preferably a locking mechanism is provided to lock the hinged portion and/or the stand off arm in angled stand off position.

In the storage position of the hinged portions 220*a*, 221*a* each stand off arm 211, 212 extends through the bore 220*b*, 221*b*, of the hinged portion 220*a*,221*a* and extends into the stile of the ladder.

As is preferred the cross member 213 lies on top of the rung 203 in the storage position.

When the stand off device is to be used, the user pulls the stand off device so that the stand off arms 211, 212 slide out of the stiles 201,202. The lower ends of the stand off arms 211, 212 then remain held by the hinged portions, here within the bores 220*b*, 221*b*, e.g. as they have cooperating abutment members. A locking mechanism, e.g. similar to mechanism 15 may be provided to lock the stand off arms with respect to the hinged portions 220*a*, 221*a*.

Once the stand off arms 211, 212 are fully slided out of the stiles, the stand off device 210 can be pivoted to its angled stand off position with the lower end portions still retained by the connector part. Preferably a further locking mechanism is provided to lock the hinged portion in the angled stand off position with respect to the ladder.

Figure 12A:
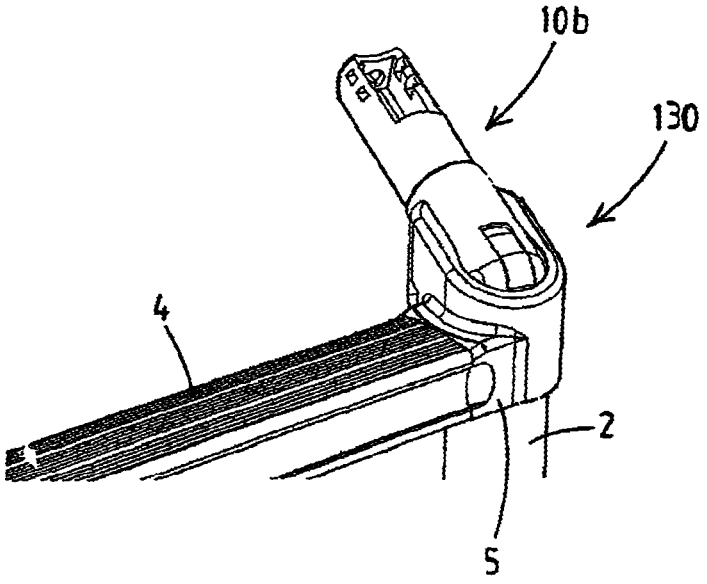
Figure 12B:
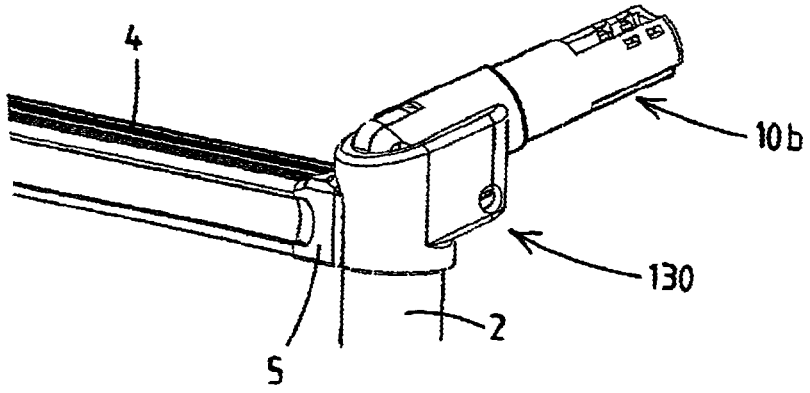
Figure 12C:
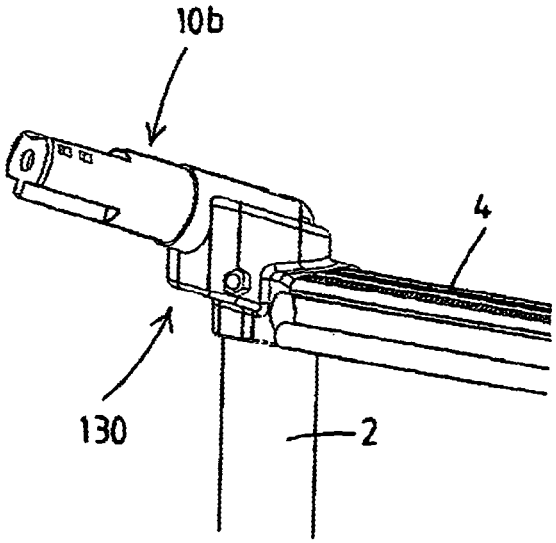

With reference to FIGS. 12*a-c* an example of a preferred optional detail of a ladder according to the invention will be discussed. Reference numerals corresponding to reference numerals used in FIGS. 1-7 will be used to identify parts of similar structure and/or function.

In FIGS. 12*a-c* on the top end of each stile 2, 3 a positioning bracket 130 is provided that is adapted to engage with the stand off arm 10, 11 when in its stand off position so as maintain the arm 10, 11 in said position. The brackets 130 are—as is preferred—embodied as rigid members, that are preferably fixedly mounted on the top end of the stiles 2,3. Here, as is preferred, the brackets 130 are integrally formed as a plastic component with the connector 5, 6 for the upper rung 4. The brackets 130 allow to pull the arm assemblies upward out of the stiles 2, 3 and then to tilt the stand off arms to their angled stand off position once the arm assemblies have been pulled upward from the stiles, e.g. as explained with reference to FIGS. 1-7.

The brackets 130 primarily serve to stabilize the arms 10, 11 in their stand off position. As is preferred the arms 10, 11 are received in the brackets 130 without play in sideways direction of the arms in stand off position. Here the brackets 130 each have a recess into which the stand off arm is lowered when it is brought into its stand off position. The recess may be formed so as to hold the arm by snap fit.

Preferably the brackets 130 maintain the arms 10, 11 in spreaded position relative to one another as is shown here As is preferred the bracket 130 is U-shaped in plan view so as to shield the hinge 12, 13 of the stand off arm against damage and the like. The hinge 12, 13—as is preferred—here lies within opposed side walls of the bracket 130.

In a possible embodiment of the ladder, preferably in combination with the bracket 130 as explained above, the base part 10*a*, 11*a* of each arm 10, 11 is guided in the associated stile 2, 3 in a non-rotational manner (not shown in the drawings). For example the base part 2,3 is non circular in cross section and the stile and/or connector on top thereof is complementary shaped. Or for example provision is made for a pin and groove guide arrangement. Preferably the guiding is such that the stand off arm assumes a spreaded stand off position.

The invention claimed is:

1. A portable telescopically extendable and collapsible ladder having an upper ladder section and multiple further ladder sections, each of said ladder sections having two tubular stiles members arranged parallel to each other and interconnected by a ladder rung, wherein the stile members of each ladder section are telescopically inserted into the stile members of an adjacent ladder section and form stiles of the ladder, the ladder further comprising latch mechanisms for locking the telescopically inserted stile members relative to one another when the ladder is extended, wherein the ladder is provided with a stand off device, said stand off device comprising two stand off arm assemblies, each stand off arm assembly being telescopically inserted into a respective tubular stile member of the upper ladder section, wherein each stand off arm assembly has a base part and a stand off arm, said base part and stand off arm being interconnected by a hinge that allows the stand off arm to be pivoted between a position in alignment with the base part and an angled stand off position, wherein the stand off arm assemblies are configured such that, in a retracted position of the stand off arm assembly, the base part, the hinge, as well as at least a portion of the stand off arm are located within the respective tubular stile member, wherein each stand off arm assembly is adapted to be pulled upwards from said retracted position into an extended position wherein the stand off arm and the hinge are out of said stile member with the base part remaining located within said stile member, wherein the stand off arm is tiltable from said extended position into said angled stand off position, wherein each stile member of the upper ladder section is provided with a positioning bracket adapted to engage on a portion of the hinge or on a portion of the stand off arm as the stand off arm is tilted into the angled stand off position, the positioning bracket stabilizing the stand off arm in said stand off position, wherein each stand off arm assembly comprises a hinge lock mechanism adapted to lock the hinge in said angled stand off position of the stand off arm, and wherein the rung of the upper ladder section is connected to each stile member via a connector element comprising a collar receiving a top end of the stile member, and wherein the positioning bracket is embodied as an integral component with said connector element.

2. A ladder according to claim 1, wherein each positioning bracket comprises a recess adapted to receive a portion of the hinge or a portion of the stand off arm therein as the stand off arm is tilted from said extended position into the angled stand off position.

3. A ladder according to claim 1, wherein the connector element is a plastic connector element and wherein the positioning bracket is an integral plastic component.

4. A ladder according to claim 1, wherein the hinge lock mechanism automatically locks the hinge when the stand off arm reaches its angled stand off position, and wherein the hinge lock mechanism includes a user operable actuator to effect release of the hinge lock mechanism.

5. A ladder according to claim 4, wherein the user operable actuator of the hinge lock mechanism is a sliding actuator provided on the stand off arm and slidable in a longitudinal direction of the stand off arm.

6. A ladder according to claim 5, wherein the sliding actuator is recessed in the portion of the stand off arm that is located within the respective stile member when the stand off arm assembly is in said retracted position.

7. A ladder according to claim 1, wherein a stand off arm assembly latch mechanism is housed within the rung of the upper ladder section, said stand off arm assembly latch mechanism being adapted to engage on the base part to latch each stand off arm assembly in its extended position.

8. A ladder according to claim 1, wherein each stand off arm is a tubular arm provided with an end cap, and wherein the end caps are embodied as fenders of the ladder, each end cap having an exterior of which at least a portion is of thermoplastic rubber.

* * * * *